US008590805B2

(12) United States Patent
Fujikawa

(10) Patent No.: US 8,590,805 B2
(45) Date of Patent: Nov. 26, 2013

(54) NOZZLE FOR GENERATING MICROBUBBLES

(76) Inventor: Susumu Fujikawa, Saitama (JP)

( * ) Notice: Subject to any disclaimer, the term of this patent is extended or adjusted under 35 U.S.C. 154(b) by 770 days.

(21) Appl. No.: 12/823,814

(22) Filed: Jun. 25, 2010

(65) Prior Publication Data

US 2011/0315796 A1 Dec. 29, 2011

(51) Int. Cl.
*B05B 1/32* (2006.01)
*B05B 15/02* (2006.01)

(52) U.S. Cl.
USPC ..... 239/106; 239/541; 239/571; 239/583

(58) Field of Classification Search
USPC ..... 239/8, 10, 31, 32, 106, 108, 428.5, 432, 239/533.1, 541, 569–571, 583, 589, 590, 239/590.3; 137/528, 535, 571
See application file for complete search history.

(56) References Cited

U.S. PATENT DOCUMENTS 3,782,640 A * 1/1974 Kirschmann ..... 239/571
2007/0235559 A1* 10/2007 Miyake ..... 239/205
2010/0176221 A1* 7/2010 Cunningham et al. ..... 239/525

* cited by examiner

*Primary Examiner* — Darren W Gorman
(74) *Attorney, Agent, or Firm* — Arent Fox LLP

(57) ABSTRACT

A nozzle for generating microbubbles includes a nozzle main body provided with a water introduction port for introducing pressurized hot water from the bottom center of the nozzle main body into the main body. A core cylinder provided with an opening in a circumferential face is inserted into the nozzle main body to form a throttle part between an edge part of the bottom outer circumference of the core cylinder and an edge part of the bottom inner circumference of the nozzle main body. A gripper is provided for pulling the core cylinder in the direction opposite to the inserting direction. Hot water passed through the throttle part is introduced into the inner part of the core cylinder through the opening of the circumferential face of the core cylinder and hot water in which microbubbles are generated is ejected to the outside.

3 Claims, 3 Drawing Sheets

NOZZLE FOR GENERATING MICROBUBBLES

BACKGROUND OF THE INVENTION

1. Field of the Invention

The present invention relates to a nozzle for generating microbubbles for generating microbubbles in hot water mainly for the purpose of cleaning.

2. Related Background of the Invention

In order to generate microbubbles, some systems are proposed, and, as one of them, there is such a system that hot water dissolving a gas such as air is pressurized, forced to pass through a throttle part and depressurized to enable the dissolved gas to appear as microbubbles in the hot water.

As a nozzle for generating microbubbles using such a throttle part, there is known one having an orifice provided with appropriate numbers of small holes functioning as a throttle part built in the nozzle main body (see, for example, Japanese Patent No. 3762404 (paragraph 0024, FIG. 2)).

SUMMARY OF THE INVENTION

In the above conventional nozzle, the small hole provided for the orifice corresponds to the throttle part. When the nozzle having such small hole as the throttle part is used for cleaning, in particular, when hot water containing a cleaning agent is circulated, if the removal of foreign particles gotten into the hot water is insufficient, the foreign particle might clog the small hole to block it up. Since the number of the small holes is supposed to be comparatively small, the blockage of only one to two small holes largely influences the condition of generating microbubbles to result in insufficient generation of microbubbles. Moreover, such trouble also occurs that the load on the motor of a pump pressurizing the hot water increases to shorten the life of the motor.

In order to eliminate the trouble, it is necessary to disassemble the nozzle and to exchange the orifice or clean the small hole of the orifice, but such disassembly and cleaning can not be easily performed in places where the nozzle is actually used, and the use thereof must be stopped for a long time every cleaning.

Therefore, in consideration of the above problem, the present invention aims at providing a nozzle for generating microbubbles that enables the removal to be easily performed even when foreign particles clog the throttle part.

In order to solve the problems, the nozzle for generating microbubbles according to the present invention is a nozzle for generating microbubbles by passing pressurized hot water through a throttle part to be depressurized and making gas dissolved in the hot water appear as microbubbles, wherein the nozzle is provided with a bottomed cylindrical nozzle main body having a water introduction port for introducing pressurized hot water from the bottom center of the nozzle main body into the nozzle main body, and a bottomed cylindrical core cylinder provided with an opening for circumferential face is inserted into the nozzle main body so as to assure a prescribed space relative to the inner surface of the nozzle main body to form the throttle part between the edge part of the bottom outer circumference of the core cylinder and the edge part of the bottom inner circumference of the nozzle main body, the hot water passed through the throttle part is introduced into the core cylinder through the opening of the circumferential face of the core cylinder, and the hot water in which microbubbles are generated is ejected from the inside to the outside of the core cylinder.

In conventional nozzles, the throttle part is a small hole, but, in the above constitution, the gap formed between the edge part of the bottom outer circumference of the core cylinder and the edge part of the bottom inner circumference of the nozzle main body works as the throttle part. Accordingly, the throttle part has a ring shape instead of a small hole.

The above core cylinder is energized by a prescribed energizing force in the inserting direction, and, by constituting the nozzle so that the core cylinder may be moved toward the direction opposite to the inserting direction against the energizing force by the pressure of the hot water introduced from the water introduction port to broaden the space of the throttle part and thereby enable the blocking to be released when the blocking occurs in the throttle part caused by foreign particles and the like, there is no need for periodical disassembly and cleaning of the nozzle, and, even when foreign particles clog the throttle part, they are automatically removed.

Meanwhile, a constitution, in which a gripper is provided for pulling the core cylinder in the direction opposite to the inserting direction to forcibly move the core cylinder against the energizing force by pulling the gripper and to be capable of releasing the blocking of the throttle part, the throttle part can periodically be cleaned without the disassembly of the nozzle.

Moreover, by adopting such constitution that the position of the core cylinder is moved in the inserting direction to enable increase/decrease adjustment of the space of the throttle part, the space of the throttle part may directly be adjusted finely even when the condition of generating microbubbles varies caused by the variation of pressure or temperature change of the hot water.

By narrowing the space between the bottom inner face of the nozzle main body and the bottom outer face of the core cylinder from the water introduction port toward the throttle part, it is possible to prevent the pressure lowering of the hot water before the arrival of the hot water at the throttle part.

As is clear from the above description, since the throttle part is formed in a ring shape in the present invention, the blocking of the throttle part caused by foreign particles hardly occurs as compared with conventional throttle parts utilizing small holes.

DESCRIPTION OF THE PREFERRED EMBODIMENTS

Figure 1:
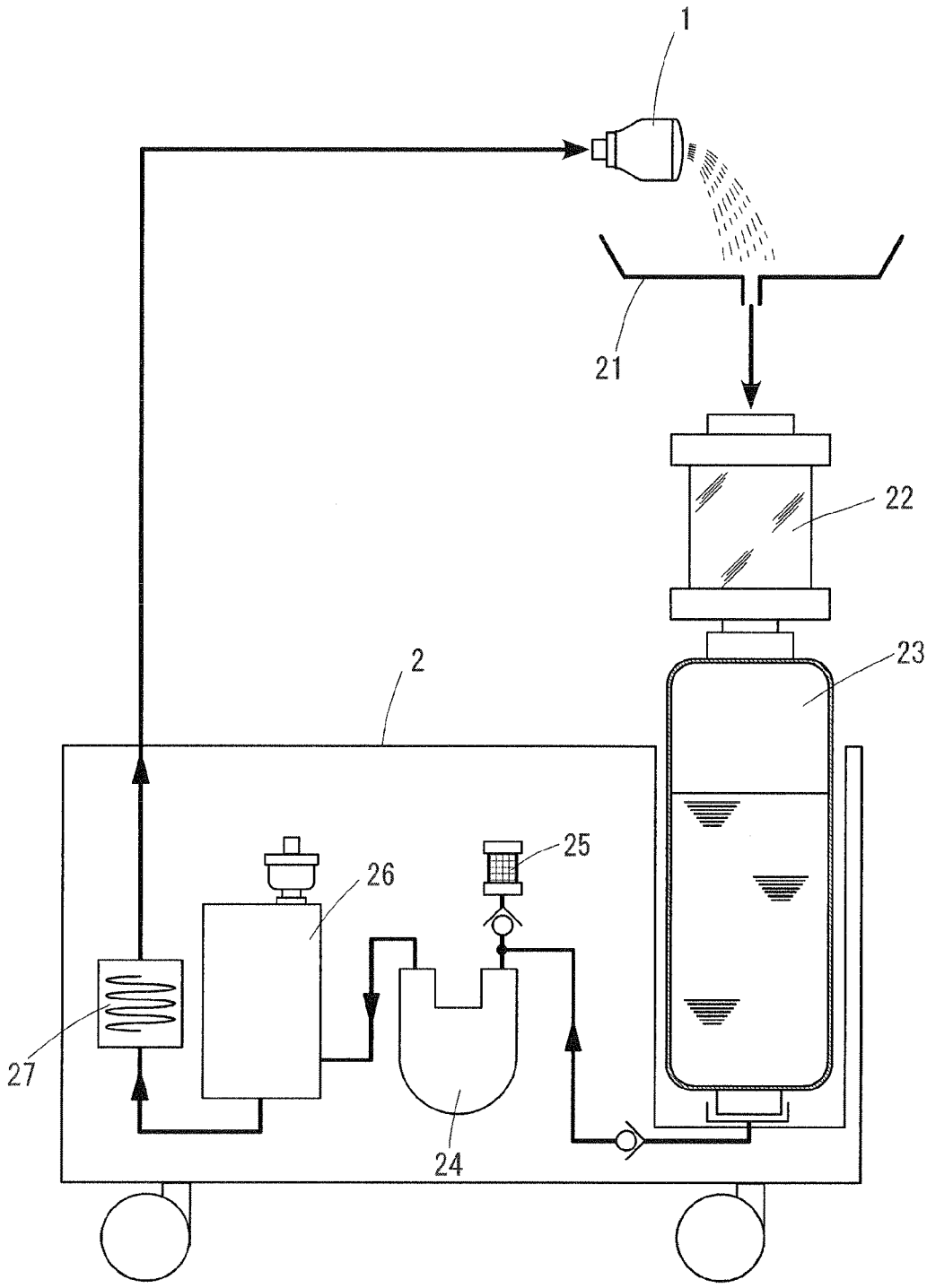
FIG. 1 is a drawing showing the constitution of an embodiment of the present invention.

While referring to FIG. 1, reference numeral 1 denotes a nozzle for generating microbubbles according to the present invention (hereinafter, referred to as the nozzle). The nozzle 1 is connected to a pump unit 2, and generates microbubbles in a pressurized hot water supplied from the pump unit 2 to eject it to a sink 21. An object to be cleaned is previously set in the sink 21, and the hot water containing microbubbles ejected from the nozzle 1 is splashed to the object to be cleaned to perform the cleaning.

The hot water is sucked from the sink 21 to a filter 22, where foreign particles are removed, and then the hot water is collected in a tank 23. The hot water in the tank 23 is sucked by a pump 24, and, on this occasion, air sucked via an air filter 25 and the hot water sucked from the tank 23 are stirred and mixed in the pump 24 to be sent to a gas-liquid separation tank 26.

Since the air and hot water are stirred and mixed in the pump 24, the air dissolves in the hot water. Air remained in an insoluble and bubble state is, however, separated from the hot water in a gas-liquid separation tank to be discharged. The hot water from which bubbles are separated is heated to a proper temperature with a heater 27, and then is sent again to the nozzle 1.

Figure 2:
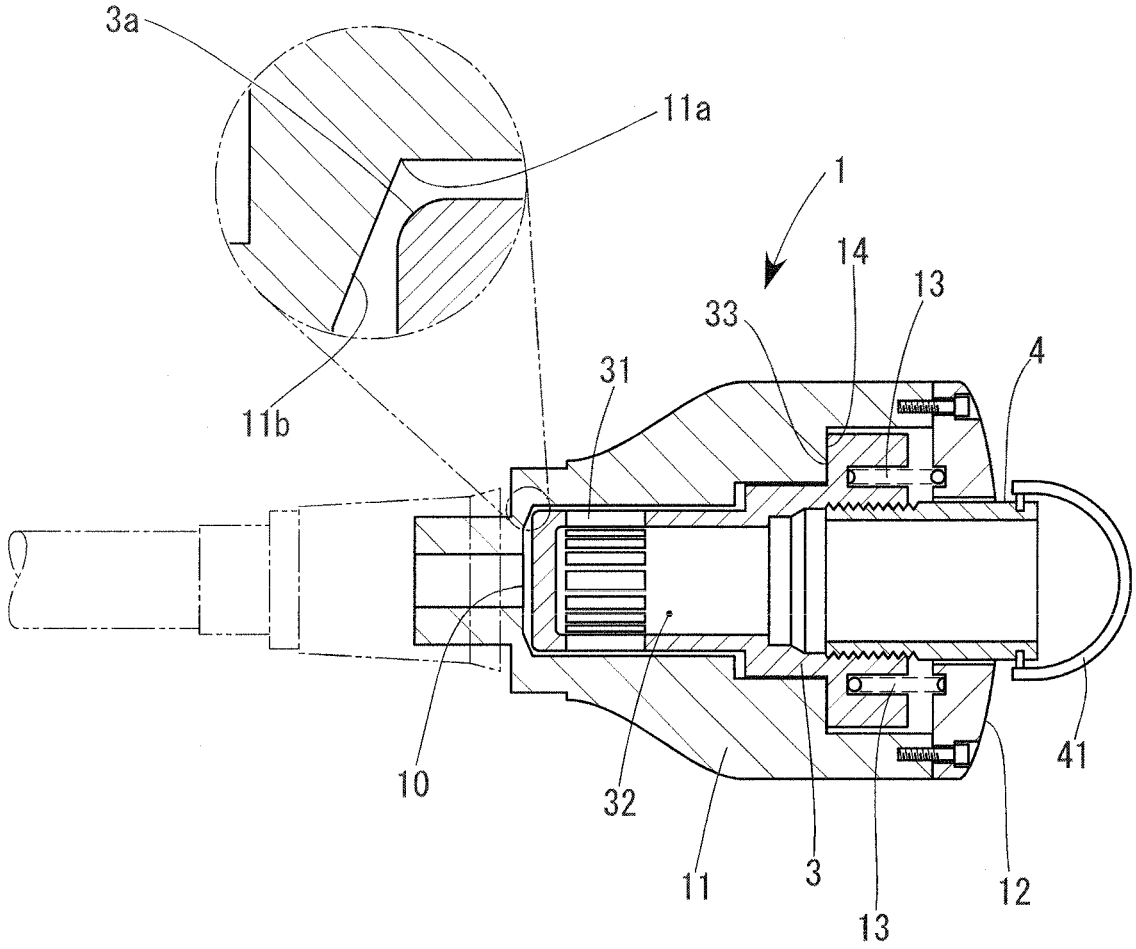
FIG. 2 is a cross-sectional view showing a structure of the nozzle.

With reference to FIG. 2, the nozzle 1 is provided with a nozzle main body 11 in a bottomed cylindrical shape, and, from a water introduction port 10 opening at the center of the bottom of the nozzle main body 11, pressurized hot water is pressure-fed into the nozzle main body 11. In the nozzle main body 11, a core cylinder 3 in a bottomed cylindrical shape is attached. For the circumferential face of the core cylinder 3, an opening 31 is provided around the entire circumferential face, and the hot water pressure-fed through the water introduction port 10 reaches the opening 31 through the space between the inner peripheral face of the nozzle main body 11 and the outer peripheral face of the core cylinder 3, enters an inside 32 of the core cylinder 3 through the opening 31, and is ejected to the outside.

At the front edge of the nozzle main body 11, a cover 12 is attached, and, between the cover 12 and the core cylinder 3, a coil spring 13 is attached. Accordingly, by the energizing force of the coil spring 13, the core cylinder 3 is always energized toward the water introduction port 10 side. Meanwhile, inside the nozzle main body 11, a step part 14 is formed, and, to the step part 14, a step part 33 protruding from the outer periphery of the core cylinder 3 abuts to function as a stopper against the movement of the core cylinder 3 toward the water introduction port 10 side. That is, a state is constituted so that the step part 33 of the core cylinder 3 is pressed against the step part 14 of the nozzle main body 11 by the coil spring 13.

As described above, the core cylinder 3 is set so that a gap is formed between an edge part 3*a* of the core cylinder 3 and an edge part 11*a* of the nozzle main body 11 in a state where the step part 33 of the core cylinder 3 is pressed against the step part 14 of the nozzle main body 11, and that the gap works as a throttle part. Accordingly, as the result of the passage of the pressurized hot water, which is pressure-fed from the water introduction port 10 as described above, through the throttle part, microbubbles appear in the hot water. Then, the hot water containing microbubbles thus appeared is ejected outside through an inner part 32 of the core cylinder 3.

In the above constitution, since the throttle part is formed in a ring shape, the blocking of the entire throttle part does not occur even if foreign particles jam into the throttle part. Moreover, when the amount of jamming foreign particles increases to reduce the area through which the hot water can pass, the pressure of the hot water pushes the core cylinder 3 to move the core cylinder 3 toward the right side in the drawing, against the energizing force of the coil spring 13. Consequently, the gap functioning as the throttle part broadens, and the jamming foreign particles are washed away by the hot water to be automatically cleaned. After the removal of foreign particles, the core cylinder 3 returns again to the state shown in the drawing.

Meanwhile, to the front edge of the core cylinder 3, an auxiliary tube 4 is attached, and the auxiliary tube 4 is provided with a freely foldable handle 41 at the front end thereof. When foreign particles jam into the throttle part, as described above, they are removed automatically, but foreign particles can be forcibly removed before a large amount of foreign particles jam into the throttle part by pulling the handle 41 to move forcibly the core cylinder 3.

Moreover, a bottom inner face 11*b* of the nozzle main body 11 is constituted so as to incline from the water introduction port 10 toward the edge part 11*a* to narrow the space relative to the bottom outer face of the core cylinder 3 toward the nozzle part. Supposing that the space working as the pathway of the hot water is constant, the area of the pathway of the hot water practically increases when the pathway goes toward the throttle part because the circumference broadens, which lowers the pressure of the hot water when it goes toward the throttle part. Hence, the bottom inner face 11*b* is inclined as shown in the drawing so that the pressure of the hot water does not lower on the way when the hot water goes from the water introduction port 10 to the throttle part.

Incidentally, in order to increase or decrease the generating amount of microbubbles during the use, it is sufficient to increase or decrease the space of the throttle part. In the nozzle shown in FIG. 2, however, the space of the throttle part can not be adjusted. Consequently, when the space of the throttle part is to be adjusted, a constitution shown in FIG. 3 may be adopted.

Figure 3:
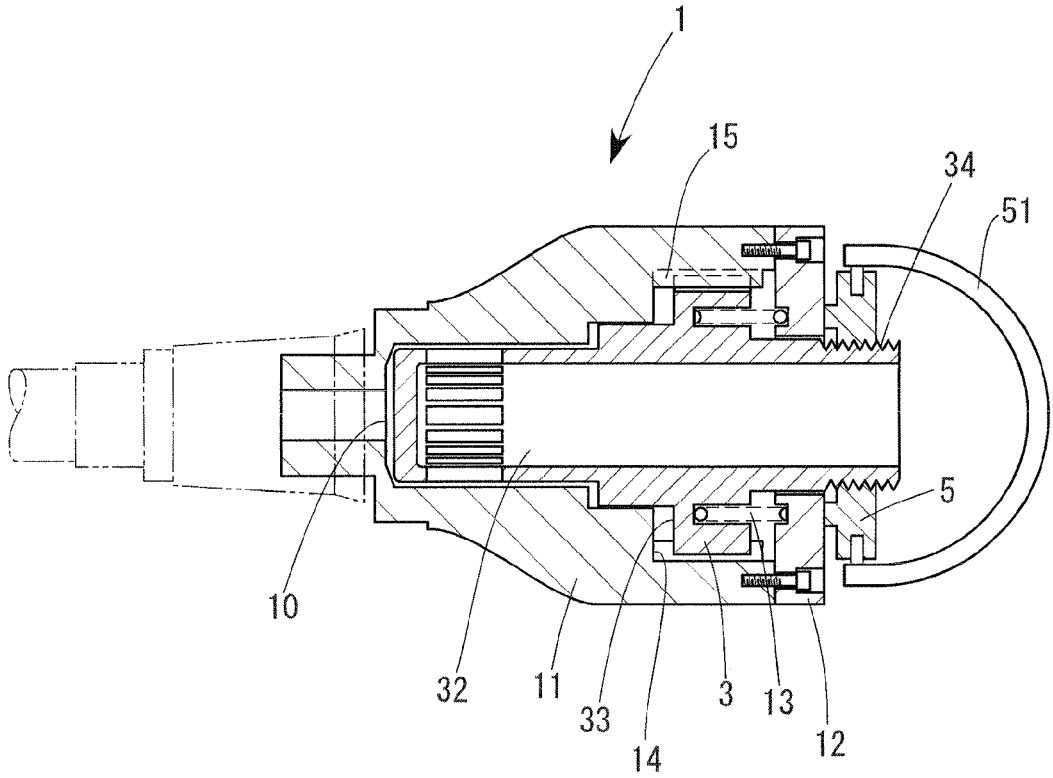
FIG. 3 is a cross-sectional view showing another structure of the nozzle.

In the constitution shown in FIG. 3, the front edge of the core cylinder 3 is projected in front of the cover 12, and a dial 5 is screwed to the front edge. Moreover, the step part 14 is moved backward to constitute so that the step part 33 does not abut against the step part 14, and a detent 15 is provided on the nozzle main body 11 side so that the core cylinder 3 does not rotate.

With this constitution, the turn of the dial 5 moves the position of the core cylinder 3 in back and forth direction to increase or decrease the space of the throttle part. Meanwhile, in the above constitution, too, core cylinder 3 moves automatically, when a large amount of foreign particles jam into the throttle part to make it possible to automatically remove foreign particles, and to forcibly remove foreign particles by pulling the handle 51 provided for the dial 5.

Meanwhile, the present invention is not limited to above-described embodiments, and various modifications may be added within the range that does not depart from the gist of the present invention.

What is claimed is:

1. A nozzle for generating microbubbles by passing pressurized hot water through a throttle part to be depressurized and making gas dissolved in the hot water appear as microbubbles, wherein the nozzle is provided with a bottomed cylindrical nozzle main body having a water introduction port for introducing pressurized hot water from a bottom center of the nozzle main body into the nozzle main body, a bottomed cylindrical, hollow core cylinder provided with at least one opening in a circumferential face of the core cylinder is inserted into the nozzle main body so as to assure a prescribed space relative to an inner surface of the nozzle main body to form the throttle part between an edge part of a bottom outer circumference of the core cylinder and an edge part of a bottom inner circumference of the nozzle main body, the hot water passed through the throttle part is introduced into the hollow core cylinder through the at least one opening in the circumferential face of the core cylinder, and the hot water in which microbubbles are generated is ejected from an inside to an outside of the core cylinder, and a gripper is provided for pulling the core cylinder in the direction opposite to the inserting direction; and wherein the core cylinder is energized by a prescribed energizing force in the inserting direction, and that the core cylinder is moved toward the direction opposite to the inserting direction against the energizing force by the pressure of the hot water introduced from the water introduction port to broaden the space of the throttle part and thereby enable any blockage to be released when blocking occurs in the throttle part caused by foreign particles and the like and the blocking of the throttle part can also be released by pulling the gripper to forcibly move the core cylinder against the energizing force.

2. The nozzle for generating microbubbles according to claim 1, wherein the core cylinder is configured to be moved in the inserting direction to enable increase/decrease adjustment of the space of the throttle part.

3. The nozzle for generating microbubbles according to claim 1, wherein a space between a bottom inner face of the nozzle main body and a bottom outer face of the core cylinder is narrowed from the water introduction port toward the throttle part.

* * * * *